United States Patent [19]

Curtis

[11] Patent Number: 4,994,793

[45] Date of Patent: Feb. 19, 1991

[54] WEIGHT SHIFT DETECTOR

[76] Inventor: Kevin Curtis, 3265 Harrow Rd., Spring Hill, Fla. 34606

[21] Appl. No.: 447,623

[22] Filed: Dec. 8, 1989

[51] Int. Cl.[5] ..... G08B 13/14

[52] U.S. Cl. ..... 340/666; 307/119

[58] Field of Search ..... 340/666; 307/119

[56] References Cited

U.S. PATENT DOCUMENTS

| | | | |
|---|---|---|---|
| 2,683,784 | 7/1954 | Rector | 200/86 |
| 2,783,327 | 2/1957 | Luckey | 200/86 |
| 3,496,381 | 2/1970 | Wisnia | 307/125 |
| 3,604,958 | 9/1971 | Palini | 340/666 |
| 3,846,780 | 11/1974 | Gilcher | 340/562 |
| 4,057,791 | 11/1977 | Bimmerle et al. | 340/571 |
| 4,245,219 | 1/1981 | Dempsey et al. | 340/666 |
| 4,401,896 | 8/1983 | Fowler et al. | 307/118 |
| 4,539,560 | 9/1985 | Fleck et al. | 340/573 |
| 4,661,664 | 4/1987 | Miller | 200/86 |
| 4,855,711 | 8/1989 | Harrop et al. | 340/666 |

*Primary Examiner*—Glen R. Swann, III

*Attorney, Agent, or Firm*—Warren L. Franz

[57] ABSTRACT

A device for detecting intrusion for security or inventory control purposes includes a mat having loosely superposed metallic foil sheets separated by a sheet of paper or plastic foil dielectric to form a capacitor, and circuitry connected to provide a voltage differential to the capacitor and to detect a change in capacitance caused by weight applied to or removed from the mat. The circuit includes a voltage regulator to regulate the applied voltage differential, a unity gain amplifier to isolate the mat capacitor from change signal amplifier circuitry, a comparator to compare the amplified change signal with user settable thresholds, and a one-shot multivibrator for initiating an alarm signal pulse when one of the thresholds is exceeded. The sheets are preferably aluminum foil backed with plastic film and, in one form, are wrapped one around the other.

17 Claims, 2 Drawing Sheets

WEIGHT SHIFT DETECTOR

This invention relates to a capacitance actuated weight shift detector, especially useful as a mat-type security device for detecting intrusion or the like.

BACKGROUND OF THE INVENTION

Mat intrusion detectors of the type to which the present invention finds application usually take the form of contact switches having spaced electrical contacts that connect when weight is applied to the mat and are biased apart to separate when weight is removed. An example of such an arrangement is shown in Miller U.S. Pat. No. 4,661,664, wherein two conductive sheets of aluminum foil are separated by a nonconductive intermediate spacial layer of insulation material which has openings therein through which the foil plates may be contacted when weight is applied to the mat. Other examples of similar arrangements are shown in U.S. Pat. Nos. 2,683,784; 2,783,327; 4,245,219; 4,401,896; 4,057,791 and 4,539,560.

Such mat switches detect intrusion by establishing contact between the plates. In order to set such alarms, it is necessary for the mat to be cleared of all objects, except perhaps during a brief timed period which is set by circuitry to give a delay sufficient to clear the area after arming. The switch is either "on" or "off", so leaving an object on the mat of sufficient weight to compress the plates will either prevent arming or leave the mat in an alarm state. When this happens, an intruder stepping onto the mat will not be detected because the status of the system will not change.

For spot protection of precious objects, such as museum treasures and the like, the operation of the mat can be reversed so that the normal, nonalarm state occurs when the plates are in contact and the alarm state occurs when the plates are separated. Thus, for example, an alarm will be given when a precious vase placed to assume a usual position of rest on a mat is raised up off the mat. Again, however, the mat is either in an alarm "on" or an alarm "off" status in accordance with whether the plates are contacting or not.

There is a problem with adjusting the sensitivity of such "on" or "off" contact mats because no discrimination is made in the electrical circuitry as to the level of the switch signal. And, while some attempt can be made to avoid alarm due to false triggers such as the passage of dogs or cats and the like, the capability for eliminating unwanted activation is limited. Changes can be made in the characteristics of the material separating the plates or making up the external mat covering to provide resistance against bringing the plates together until a certain threshold weight is applied. Such mechanical "tweaking" is, however, a coarse adjustment at most and does not provide for the on-site, fully adjustable, user controllable sensitivity desired in order to have an effective security system.

The utilization of capacitance effects in connection with intrusion detection is known for both vibration detectors and proximity detectors, both of which operate on principles different from the applied (or removed) weight principle employed in the contact mat, described above. A typical vibration detector will, for instance, have a first contact loosely positioned in the vicinity of a second contact so that momentary vibration of the first contact in response to intrusion-induced vibration will change the spacing and, thus, the capacitance of the contacts, to thereby trigger an alarm. Such a system is described in Gilcher U.S Pat. No. 3,846,780.

In Gilcher, a length of insulated electrical wire is loosely coaxially positioned for free movement within the interior of an electrically conductive tube which is buried underground. Mechanical disturbances of the wire within the tube due to ground vibration causes a measurable change in capacitance between the wire and the tube, which can be monitored to activate the alarm. Such vibration detectors are, however, sensitive to non-intrusion initiated vibrational displacements as well, such as those resulting from environmental changes, remote disturbances, or the unexpected acoustical noise resulting from the sudden turning on of an air-conditioner fan motor. Some provision can be made, as in Gilcher, to analyze the frequency of the detected vibration in order to eliminate some unwanted triggerings; yet, false alarms remain a problem and sensitivity is difficult to adjust.

Proximity detectors, on the other hand, use change in space capacitance as a detection mechanism. An electric flux is established through the air between a sensing wire or object (such as a metal safe or filing cabinet) to be protected and the surrounding building structure or ground area. When an intruder approaches, the flux is caused to flow through the higher dielectric constant of the intruder's body results in an increase in space capacitance that triggers the alarm.

Wisnia U.S. Pat. No. 3,496,381 shows an example of a proximity detector embodied as a capacitance-actuated door opener. In Wisnia, a signal plate in the form of a large flat metal sheet is mounted on the floor in front of a door opening and charged by an oscillator of preselected frequency to establish an electrical field with the surrounding area. When a person approaches the signal plate, the system responds to the increase in space capacitance by opening the door. Wisnia uses a second, generally identically-sized metal sheet between the signal plate and the floor, and maintained at the same potential as the first sheet, in order to mask the system against operation due to unwanted changes in capacitance due to traffic on the floor below. Nevertheless, because such devices require establishment of the electric flux in the surrounding air so that it can pass through an approaching body, they remain sensitive to false triggering due to normal changes in ambient conditions like temperature and humidity, and experience deterioration in performance when operated near large objects and close to walls. This is so, even though the sensitivity of some systems is intentionally set so that the intruder must actually touch the sensing wire or protected object to activate the alarm.

SUMMARY OF THE INVENTION

It is an object of the present invention to provide a weight shift detector suitable as an intrusion detector mat, which is capacitance activated to respond to dynamic shifts in weight applied to the mat, i.e. weight added, weight moved, or weight removed, and which can be armed even when statically loaded.

A weight shift detector in accordance with the invention comprises a mat having first and second oppositely disposed plates separated by an intermediate layer of a dielectric material. Electrical circuitry connected across the plates is configured to respond to a change in separation of the plates brought about by a dynamic shift in weight to actuate a desired response. In application as an intrusion detector, the circuitry responds with an alarm signal when the change in plate capacitance exceeds a predetermined threshold value. If the new plate separation is maintained for a given period of time, the circuitry will rearm the system and go into a non-alarm mode until a minimum dynamic weight shift is again encountered.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DESCRIPTION OF THE PREFERRED EMBODIMENTS

Figure 1:
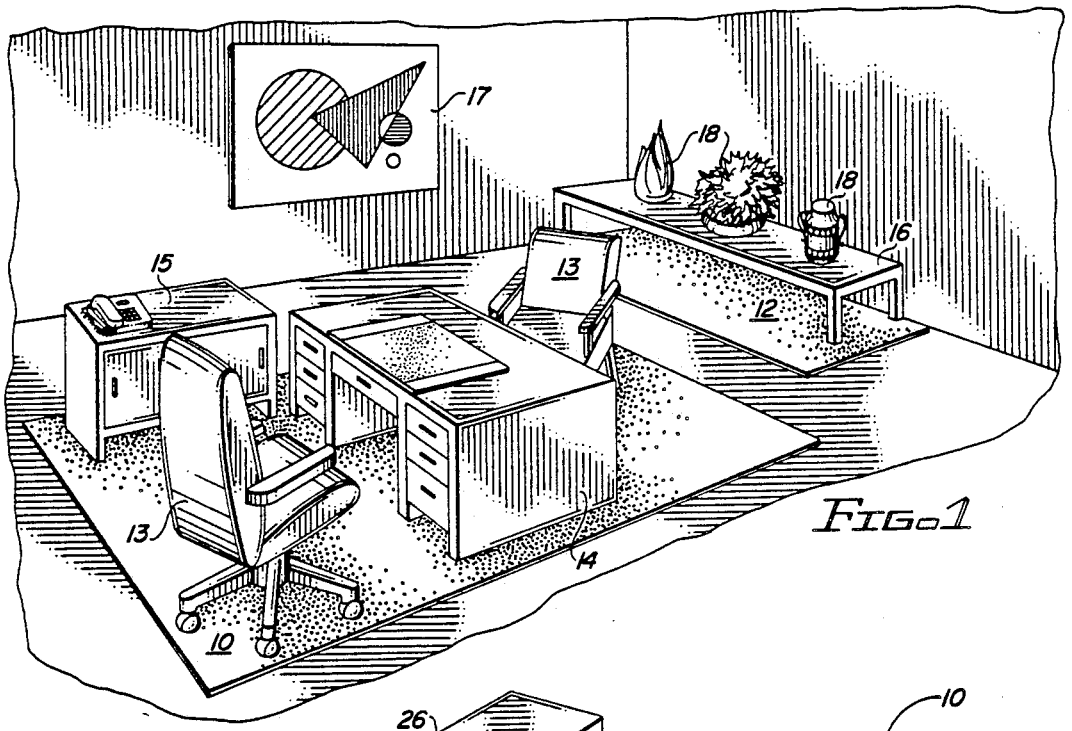
FIG. 1 is a perspective view of an embodiment of the invention shown used in an intrusion detector mat implementation.

The principles of the invention are illustrated in their application to an implementation as mat-type intrusion detectors 10 and 12 suitable for detection of unauthorized entry of persons into or removal of item from an area shown in FIG. 1. Mat 10 is centrally located, whereas mat 12 abuts the walls. Carpets (not shown) may optionally be applied overlaying the mats 10, 12 for concealment and for wear protection thereof. As shown, chairs 13 and office furniture pieces 14 and 15 are placed on top of mat 10; and a table 16 is placed on top of mat 12. A painting 17 is hung on the wall and art treasures 18 are positioned atop the table 16.

Figure 2:
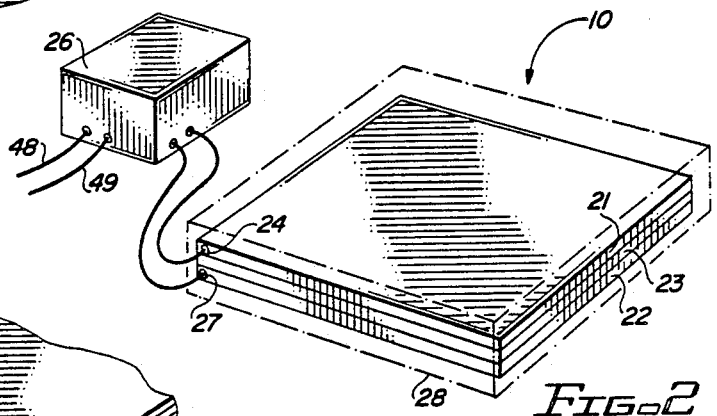
FIG. 2 is a schematic view of one form of implementation of the weight shift detector mat of FIG. 1.

The mats 10 and 12 may each comprise first and second rectangular sheets or plates 21, 22 of metallic foil separated by an intermediate layer of dielectric material 23, such as a sheet of paper or plastic. The upper plate 21 is connected at a terminal 24 to control circuitry 26, with the lower plate 22 connected at a terminal 27 to the circuitry 26 ground. The assembled plate-dielectric sandwich structure is housed within a suitable outer wear protective covering 28, shown in dot-dashed lines in FIG. 2.

Figure 3:
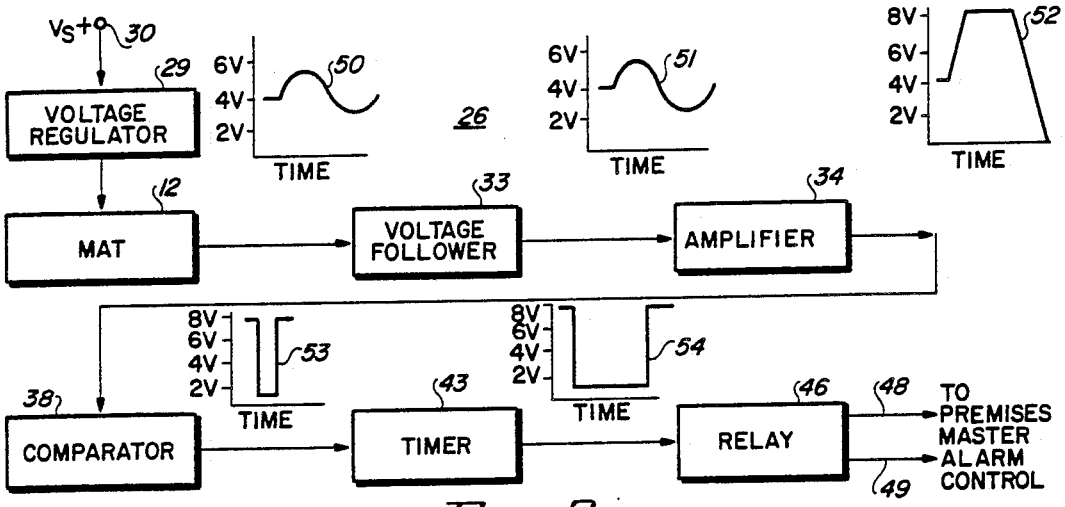
FIG. 3 is a block diagram showing an embodiment of circuitry for the device of FIGS. 1 and 2.
Figure 4:
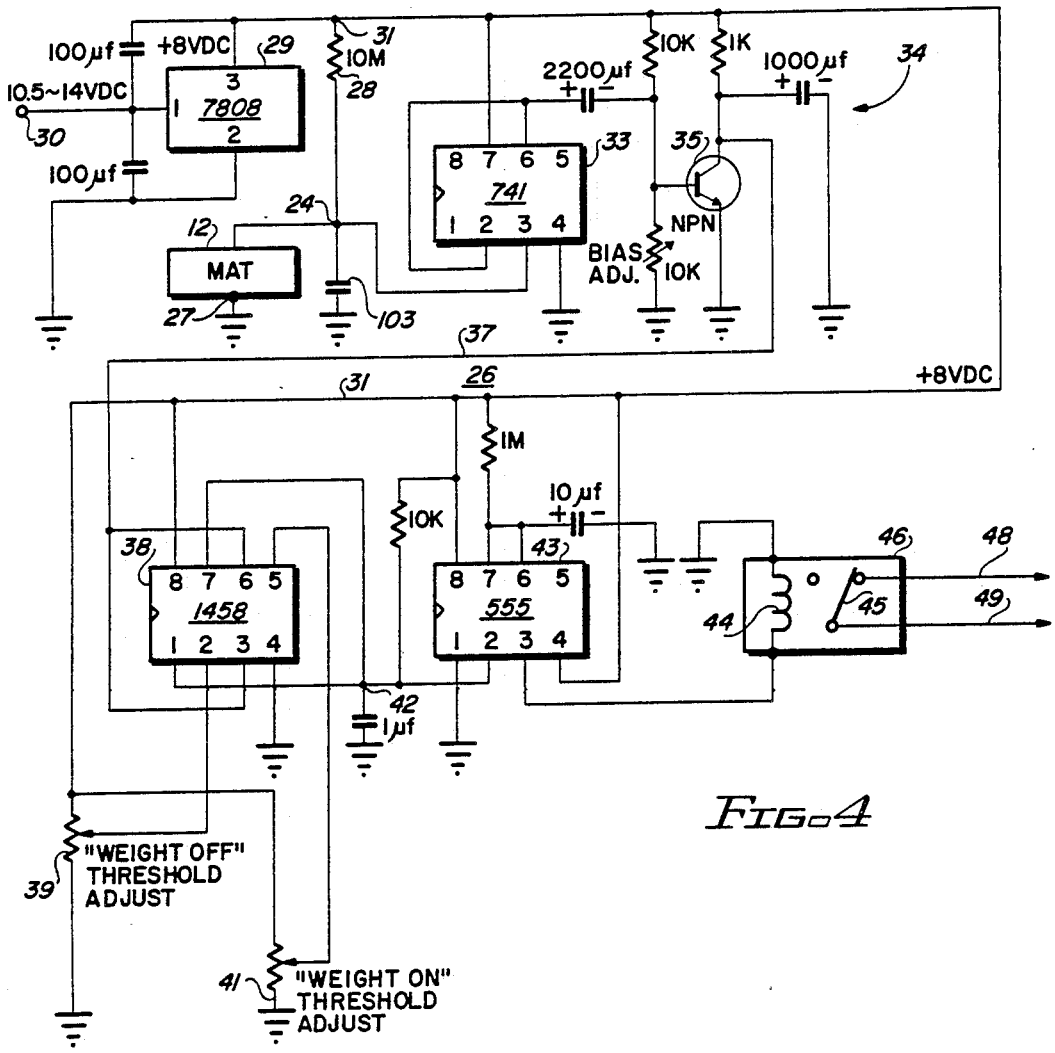
FIG. 4 is a schematic diagram of the circuitry of FIG. 3.

Details of the circuitry 26 are shown in FIGS. 3 and 4. Voltage is applied across the plates of the mat 12 and a series coupled resistor 28 by means of a voltage regulator 29 in the form of a 7808 three-terminal fixed voltage regulator device connected at its input to a source of voltage Vs+ to provide a +8 volt DC regulated voltage at its output 31. The connection is made so that variation of the capacitance of the mat 12 will produce a change in the voltage drop across the terminals 24, 31 of the resistor 28. The purpose of the voltage regulator is to prevent the alarm from triggering due to normal fluctuations in voltage of the voltage source Vs+. The terminal 24 is connected to a 741 operational amplifier configured as a unity gain amplifier, which acts as a voltage follower 33 to provide isolation. The output of the voltage follower 33 is connected for amplification to an amplifier 34 which may comprise an NPN transistor 35 or an operational amplifier. The output terminal 37 of the amplifier 34 is connected to deliver the amplified signal to a comparator 38, which may be a 1458 dual operational amplifier connected as shown to determine whether the delivered signal exceeds the "weight off" or "weight on" thresholds set by adjustments made to variable resistors 39, 41. The comparator 38 is configured to provide a low signal at its output terminal 42 for a brief time interval when the voltage signal at terminal 24 exceeds a predetermined magnitude after amplification by amplifier 34. The output terminal 42 is connected as an input to a 555 timer 43 configured as a one-shot multivibrator which responds to application of a negative trigger pulse from terminal 42 to hold the voltage low for a preset period of time sufficient to energize a solenoid 44 to magnetically attract a reed or armature 45 of a relay 46 to provide a response actuation signal at terminals 48, 49 which can be connected as an input to the master control circuitry (not shown) of the protected premises.

The plates 21, 22 and intervening dielectric 23 are relatively configured, dimensioned and adapted so that their spatial relationships are altered or the thickness or character of the dielectric is changed when weight of appropriate magnitude is added to or removed from the upper plate 21. This can be appropriately accomplished by loosely superposing the plates 21, 22 and the dielectric 23 so that a variable air gap exists on one or both sides of the dielectric 23. A simple implementation of this would be to loosely separate two sheets of metallic foil with an intervening sheet of paper. When weight is added to or removed from the top sheet of foil, the separation of the foils and the amount of air gap separating them from the paper will change and local distortions in the foil and the paper will occur, all of which will contribute to a change in the capacitance of the mat 12 that is discernable as a change of voltage at terminal 24.

Figure 5:
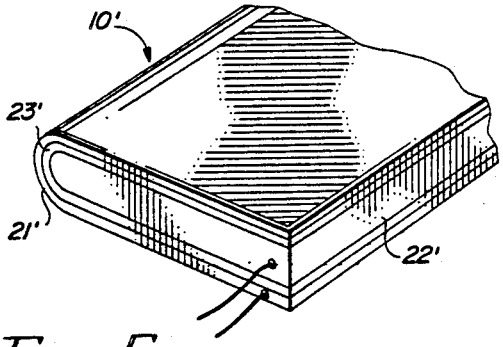
FIG. 5 is a schematic view of a modified form of the mat of FIG. 2.

FIG. 5 shows an alternate embodiment 10' of the mat 10, wherein a single rectangular sheet of aluminum Mylar TM foil with a backing of polyester film is used as both a plate 21' and a dielectric 23'. The foil-film sheet is wrapped around a backed or unbacked foil sheet 22' whose area is approximately one-half that of the total sheet area of plate 21'. This provides two capacitors acting in parallel.

In operation, when an intruder steps onto the floor area covered by the mat 10 or disturbs one of the chairs 13 or a furniture piece 14 or 15 (FIG. 1), the capacitance of the mat 10 will be altered. A similar alteration of capacitance will be experienced by the mat 12, if one of the art treasures 18 is lifted off the table 16. This change in capacitance will generate a transient voltage signal 50 (FIG. 3) at the output 24 (FIG. 4) of the mat 12 which is passed as a like signal 51 (FIG. 3) by the voltage follower 33 as an input to the amplifier 34. Amplifier 34 then, in turn, generates an amplified signal 52 (FIG. 3) which is fed to pins 3 and 6 of the comparator 38 to serve as one input to both of the dual amplifiers of the 1458 circuit (FIG. 4). The comparator 38 is configured to compare the amplified signal 52 applied as an input at pin 3 with a "weight off" threshold voltage set at resistor 39 and applied as an input to pin 2. Comparator 38 is also configured to compare the signal 52 applied at pin 6 with a "weight on" threshold voltage set at resistor 41 and applied at pin 5. The outputs of the comparisons respectively delivered at pins 1 and 7 appear at the output terminal 42 (FIG. 4) of the comparator 38. If either the magnitude of signal 52 exceeds the "weight off" threshold set at resistor 39 or the "weight on" threshold set at resistor 41, the output 42 of the comparator 38 will be driven low for a brief interval as shown by the signal 53 (FIG. 3). The signal 53 is then passed as a trigger signal to the input pin 2 of the 555 timer 43 configured as a one-shot multivibrator circuit, which triggers the timer 43 to send a timed pulse signal 54 (FIG. 3) to the solenoid 44 (FIG. 4) of the relay 46, causing a temporary shift in position of the reed 45, to produce an actuation signal at terminals 48, 49.

Because the spacing of the plates 21, 22 (or the change in character or dimension of the dielectric 23) does not occur unless weight is being removed or added to the mat 10 or 12, once the time increment of the pulse signal 54 has passed, the relay 46 will return to its former, steady state. Thus, chairs 13, furniture pieces 14 15, table 16 and art treasures 18 applied to the mats 10, 12 for a period of time greater than the duration of pulse 54 will not interfere with the arming of the system. This is an advantage over contact mat systems like those of the Miller patent which cannot be set to detect intrusion unless the mat is completely cleared. Also, because the mats 10, 12 have oppositely positioned, superposed plates 21, 22 and do not depend on space capacitance for operation, in contrast to detectors such as those shown in the Gilcher patent, they are not adversely affected by the size or dielectric character of objects placed nearby, by proximity to walls and other adjacent building structures, or by activity occurring in neighboring unprotected areas.

Furthermore, unlike the previously discussed prior art systems, the mats 10, 12 of the weight detection system according to the present invention have full user-adjustable threshold sensitivity seeking capability. The change in capacitance needed to trigger an alarm either for removal of weight from the mat ("weight off" threshold) or addition of weight to the mat ("weight on" threshold) can therefore be individually adjusted so that the alarm will trigger only for certain spacing changes in the plates 21, 22, etc., corresponding to removal or application of a certain weight per area.

Figure 6:
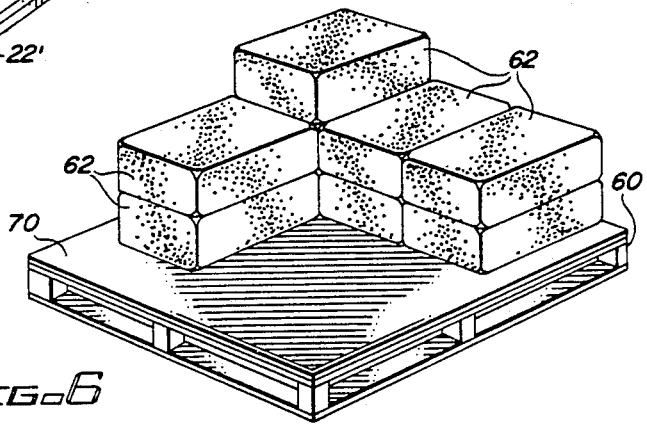
FIG. 6 is a perspective view of the mat of FIGS. 1–4 shown used in an inventory control implementation.

FIG. 6 illustrates application of the principles of the invention to an embodiment in the form of a mat 70' applied to a warehouse pallet or retail store shelf 60 as a stacking surface for a plurality of countable items, such as bags of flour 62. The mat 70' is suitably connected to a circuit 26, as previously discussed, with sensitivity set to trigger a response whenever a unit 62 is removed from or added to the pallet or shelf 60. The circuit 26 can be connected to an alarm, as before, to monitor theft. The circuit can also be connected to a counter or other indicator to serve as an inventory control flag for signalling that a change has occurred in the stack of units since the last inventory was taken, so the pile must be recounted. When no change has occurred, the last inventory count can be used. Connected to a counter, the circuitry 26 can also be modified to increment the counter down when weight equal to a unit 62 is removed and up when weight equal to a unit 62 is added, so that a count of items on the pallet or shelf 60 is continuously maintained.

Thus, it is apparent from the foregoing that the invention provides a capacitance actuated mat and means to cause a signal upon a change in capacitance of the mat due to plate spacing or changes in the dielectric. The system will actuate whether the change in weight is positive or negative. The system can be armed while weight is applied and its sensitivity can be user-adjusted.

Those skilled in the art to which the invention relates will appreciate that the preferred embodiments of the invention described in detail above are just examples of how the invention can be implemented, and that various substitutions and modifications may be made to the same without departing from the spirit and scope of the invention as defined by the claims below.

What is claimed is:

1. A capacitance activated weight shift detector, especially useful as a security device for detecting intrusion or the like, comprising:

a mat having first and second sheets of conductive material disposed in superposed positional relationship and a layer of dielectric material disposed intermediate said sheets to maintain the same in separated position even when weight is applied to said mat, said sheets and said intermediate layer forming a capacitor of capacitance dependent on said positional relationship, and said sheets and layer being relatively configured, dimensioned and disposed so that said positional relationship is altered when weight is applied to or removed from said mat; said positional relationship being altered to give an increasingly greater magnitude of change in said capacitance for an increasingly greater magnitude of weight applied to or removed from said mat; and electrical circuitry connected to said mat to apply a voltage differential across said sheets and to respond to a change in said capacitance due to alteration of said positional relationship to generate a signal to actuate a desired response, said circuitry including means to give said signal only when said change in capacitance due to application of weight exceeds a first threshold magnitude, or said change in capacitance due to removal of weight exceeds a second threshold magnitude; and means for enabling independent user selection of said first and second threshold magnitudes.

2. A detector as in claim 1, wherein said circuitry further comprises means for generating said signal in the form of a timed signal of time limited duration.

3. A detector as in claim 2, wherein said timed signal generating means comprises a one-shot multivibrator.

4. A detector as in claim 3, wherein said means giving said signal only when said first or second magnitude is exceeded comprises a dual amplifier circuit, with the amplifiers connected as comparators.

5. A detector as in claim 4, wherein said circuitry further comprises voltage follower means electrically isolating said mat sheets from said means to give said signal when said first or second magnitude is exceeded.

6. A detector as in claim 5, wherein said voltage follower means comprises an operational amplifier connected to provide unity gain.

7. A detector as in claim 6, wherein said circuitry further comprises an amplifier connected between said unity gain amplifier and said means giving said signal when said first or second threshold magnitude is exceeded.

8. A detector as in claim 7, wherein said circuitry further comprises a voltage regulator connected for supplying regulated voltage to said mat.

9. A capacitance actuated weight shift detector, especially useful as a security device for detecting intrusion or the like, comprising:

a mat having first and second conductive plates superposed in separated positional relationship and a dielectric located between said plates, said plates and dielectric defining a capacitor of a certain capacitance, and said plates and dielectric being relatively configured, dimensioned and disposed so that said sheets remain separated and said capacitance is changed when weight is applied to or removed from said mat;

electrical circuitry connected to said mat to apply a voltage differential to said sheets and to respond to said change in capacitance to generate a signal to actuate a desired response, said circuitry comprising voltage regulator means connected for applying a regulated voltage differential from a voltage source to said plates; means connected for generating a first signal in response to detecting a change in said capacitance; means connected for amplifying said first signal; means connected for generating a second signal when said amplified signal exceeds a predetermined threshold magnitude; and voltage follower means connected to electrically isolate said amplifying means from said means for generating said first signal.

10. A detector as in claim 9, wherein said second signal generating means comprises user settable means for selecting said threshold magnitude, means for generating a trigger signal when said amplified signal exceeds said threshold magnitude, and timer means for generating said second signal in the form of a timed signal of time limited duration in response to the presence of said trigger signal.

11. A detector as in claim 10, wherein said first signal generating means comprises means for generating a signal of one sense in response to a change in capacitance due to weight applied and a signal of opposite sense in response to a change in capacitance due to weight removed; and wherein said second signal generating means comprises means for generating said second signal when said amplified signal of one sense exceeds a predetermined first threshold magnitude or said amplified signal of opposite sense exceeds a predetermined second threshold magnitude; and said user settable means comprises means for independently selecting said first and second magnitudes.

12. A detector as in claim 9, wherein said first and second plates comprise sheets of metallic foil and said dielectric comprises a sheet of plastic foil.

13. A detector as in claim 12, wherein said first plate has a first surface area, said second plate has a second surface area of two times said first surface area, said plastic foil sheet is bonded to said metallic foil sheet of said second plate, said second plate sheet is wrapped around said first plate sheet, and said circuitry connects said sheets to form two capacitors in parallel.

14. In an intrusion detection system including a mat having first and second sheets of conductive material superposed in spaced positional relationship across a gap and means normally maintaining said sheets in noncontacting relationship, and circuitry connecting said sheets and responsive to a change in said positional relationship due to the application of weight to said mat to provide a signal for activating an alarm or the like, the improvement comprising:

said means comprising a layer of dielectric material configured, dimensioned and adapted to maintain said sheets in noncontacting relationship, even upon said application of weight, and said layer further being operatively associated with said sheets to define a capacitor having a given capacitance whose magnitude is determined by said positional relationship; and said circuitry being configured and adapted to apply a voltage differential across said sheets, and to detect a change in the magnitude of said capacitance due to a change in said positional relationship to provide said signal; and said circuitry further including means to provide said signal only when said change in capacitance due to said change in positional relationship exceeds a predetermined threshold magnitude; user settable means for setting said threshold magnitude; and a one-shot multivibrator for providing said signal in the form of a timed signal of limited time duration.

15. A capacitance activated weight shift detector, especially useful as a security device for detecting intrusion or the like, comprising:

a mat having first and second sheets of conductive material disposed in superposed positional relationship and a layer of dielectric material disposed intermediate said sheets to maintain the same in separated position even when weight is applied to said mat, said sheets and said intermediate layer forming a capacitor of capacitance dependent on said positional relationship, and said sheets and layer being relatively configured, dimensioned and disposed so that said positional relationship is altered when weight is applied to or removed from said mat; said positional relationship being altered to give an increasingly greater magnitude of change in said capacitance for an increasingly greater magnitude of weight applied to or removed from said mat; and electrical circuitry connected to said mat to apply a voltage differential across said sheets, to establish a reference value corresponding to an initial positional relationship, and to respond to a change in said capacitance from said reference value to an altered value due to alteration of said positional relationship from said initial positional relationship to generate a signal to actuate a desired response when said change in capacitance due to application of weight exceeds a first threshold magnitude, or said change in capacitance due to removal of weight exceeds a second threshold magnitude; and means for terminating said signals and for establishing said altered value as said reference value if said altered positional relationship is maintained for a predetermined time increment.

16. A detector as in claim 15, wherein said circuitry further comprises arming means to cause said circuitry to generate said signal to actuate said desired response only in response to said change in capacitance occurring after a predetermined arming time interval.

17. A detector as in claim 16, wherein said circuitry further comprises means for enabling independent user selection of said first and second threshold magnitudes, whereby said magnitudes can be set to different values.

* * * * *